United States Patent [19]

Koefferlein et al.

[11] Patent Number: 5,023,664

[45] Date of Patent: Jun. 11, 1991

[54] NON-MECHANICAL PRINTER OR COPIER MEANS COMPRISING AN EXPOSURE MEANS ARRANGED IN THE DEVELOPMENT REGION

[75] Inventors: Rainer Koefferlein, Munich; Bernhard Schlageter, Unterhaching; Erich Baier, Schweitenkirchen, all of Fed. Rep. of Germany

[73] Assignee: Siemens Aktiengesellschaft, Munich, Fed. Rep. of Germany

[21] Appl. No.: 331,665

[22] PCT Filed: Sep. 21, 1987

[86] PCT No.: PCT/DE87/00428

§ 371 Date: Mar. 22, 1989

§ 102(e) Date: Mar. 22, 1989

[87] PCT Pub. No.: WO88/02502

PCT Pub. Date: Apr. 7, 1988

[30] Foreign Application Priority Data

Sep. 24, 1986 [DE] Fed. Rep. of Germany ..... 3632474

[51] Int. Cl.[5] ..... G03G 21/00

[52] U.S. Cl. ..... 355/245; 355/266; 355/296; 118/652

[58] Field of Search ..... 355/245, 251, 266, 269, 355/296, 298, 301, 302, 305; 118/652, 657, 658

[56] References Cited

U.S. PATENT DOCUMENTS 3,424,615 1/1969 Eichorn et al. .
3,543,720 12/1970 Drexler et al. ..... 355/253 X
3,883,240 5/1975 Ito et al. .
3,912,388 10/1975 Takahashi et al. .
4,430,957 2/1984 Cherbuy et al. .
4,461,238 7/1984 Baier et al. .
4,469,427 9/1984 Kopp et al. .
4,538,901 9/1985 Soumiya .

FOREIGN PATENT DOCUMENTS 1524543 9/1978 United Kingdom .

OTHER PUBLICATIONS

Patent Abstracts of Japan, vol. 9, No. 72 (P-345) (1795), Apr. 2, 1985 for Patent No. 59-204062.
Patent Abstracts of Japan, vol. 8, No. 188 (P-297) (1625), Aug. 29, 1984 for Patent No. 59-78379.
Patent Abstracts of Japan, vol. 10, No. 206 (P-478) (2262), Jul. 18, 1986 for Patent No. 61-49669.
Patent Abstracts of Japan, vol. 10, No. 135 (P-457) (2192), May 20, 1986 for Patent No. 60-256184.

*Primary Examiner*—R. L. Moses
*Attorney, Agent, or Firm*—Hill, Van Santen, Steadman & Simpson

[57] ABSTRACT

An exposure means is provided between a development region and a carrier stripping drum that removes carrier particles, being provided inside the developer station of a non-mechanical fast data printer means. The exposure means illuminates and thereby discharges the highly charged and non-toner-covered regions of the surface of a charge image carrier. The adhesion of negative carrier particles of the developer mix to the non-exposed regions of the surface of the charge image carrier is thus reduced, so that they can be easily stripped from the surface of the charge image carrier by the following carrier stripping drum.

5 Claims, 1 Drawing Sheet

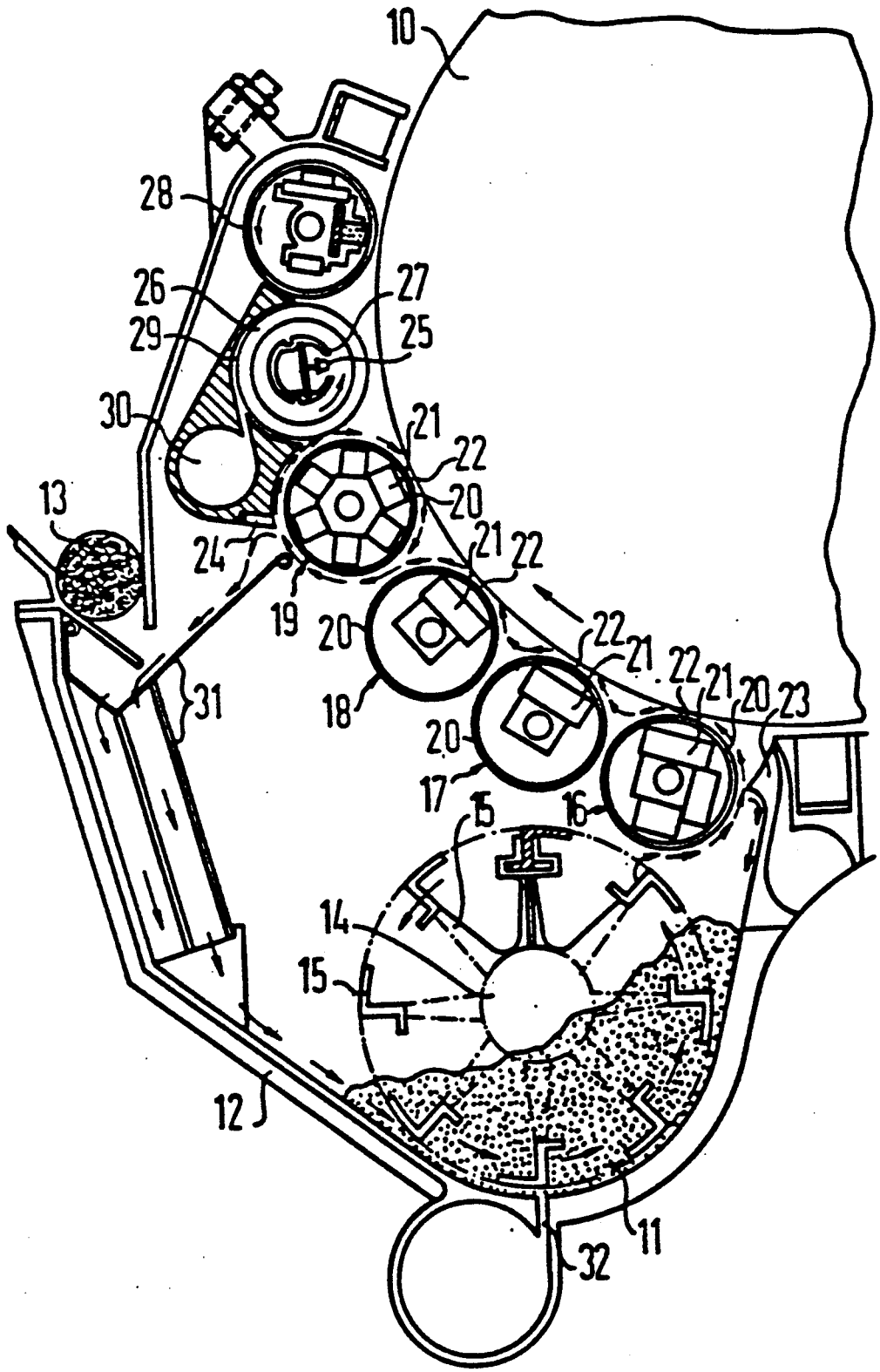
10
28
26
27
29
25
30
21
22
20
13
24
21
22
19
20
22
21
22
21
20
23
31
18
20
17
16
15
14
15
12
11
32

NON-MECHANICAL PRINTER OR COPIER MEANS COMPRISING AN EXPOSURE MEANS ARRANGED IN THE DEVELOPMENT REGION

BACKGROUND OF THE INVENTION

The invention is directed to a non-mechanical printer or copier means having a developing region for developing a charge region generated on a charge image carrier with the assistance of an exposure means using a developer mix of toner particles and carrier particles.

In copier equipment technology and in non-mechanical fast data printers that operate based on the principle of electrophotography, charge images are generated on a charge image carrier, for example on a photoconductive drum, and are subsequently inked with a colored powder, toner in a developer station. The toner images are subsequently transferred onto normal paper given employment of a photoconductive drum and are fixed there.

As a rule, a two-component developer is employed for developing, this being composed of ferromagnetic carrier particles and of colored toner particles. The developer mix, for example, is conducted past the charge image on the charge image carrier with a magnetic brush arrangement, the toner particles adhering to the charge image as a result of electrostatic forces. The magnetic brush arrangement is thereby composed of a rotatable hollow cylinder in whose interior a plurality of rows of stationary permanent magnets are arranged.

A plurality of magnetic brush arrangements can be provided in one developer station. For example, one magnetic brush arrangement can serve the purpose of transporting the developer mix past the charge image carrier. This magnetic brush arrangement shall be referred to below as a developer drum. A further magnetic brush arrangement can be employed in order to transport the developer mix out of the inside of the developer station to the developer drum. Such a magnetic brush arrangement or any other arrangement that effects such a transport of developer mix is thereby referred to below as a transport drum.

Adjoining the development region, it is also standard to remove the carrier particles of the developer mix sporadically adhering to the charge image carrier from the charge image carrier with the assistance of a carrier stripper roller likewise fashioned as magnetic brush drum and to return these carrier particles to the developer mix.

Developer stations wherein developer mix for inking the charge images on the charge image carrier with the assistance of the magnetic brush principle are employed are disclosed by German Patent 31 19 010 and corresponding U.S. Pat. No. 4,461,238.

As already set forth, a significant problem in non-mechanical printer or copier devices operating according to the principle of electrophotography is achieving the complete removal of the carrier particles from the inked charge image following the development region. In standard non-mechanical printer or copier devices that work according to the reversal development method and wherein the regions of the charge image carrier discharged via a character generator are inked, there is the risk that the carrier particles will agglomerate to those regions that are still charged and that are not to be inked. The complete removal of these carrier particles with the assistance of a carrier stripper drum is difficult.

When these carrier particles are not completely removed or, respectively, when these carrier particles are entrained by the photoconductive layer of the photoconductive drum up to the actual transfer station, then the transfer event is deteriorated. In particular, this leads to light spots and other disturbances in the printed format.

GB-A- 15 24 543 and corresponding U.S. Pat. No. 3,920,329; discloses an electrophotographic copier means that comprises an isorunning development station. The development station is followed by a carrier stripper drum that serves the purpose of removing excess developer mix from the charge image carrier. A corona discharge station is arranged between the carrier stripper drum and the development station. Corona discharge stations, however, have the disadvantage that they act both on the inked regions as well as on the non-inked regions of the charge image.

In order to facilitate the transfer of the toner particles onto the recording medium, U.S. Pat. No. 3,424,615 and DE-A- 34 01 992 disclose that an illumination means in the form of carrier lamps be arranged in moving direction of the photoconductor preceding the actual transfer station.

SUMMARY OF THE INVENTION

It is an object of the invention to fashion a non-mechanical printer or copier means of the species initially cited such that a high printing quality is possible given high process speed and use of a developer mix having a long useful life.

In a non-mechanical printer device of the species initially cited, this object is achieved in that an illumination means for a charge image carrier is arranged between a development region and means for removing the carrier particles in the development station itself, said illumination means discharging by illumination the highly charged and non-tonered regions of the charge image carrier.

The illumination means generates a largely uniform charge image on the charge image carrier preceding the transfer station in the printer that follows the actual carrier stripper means for the carrier particles and follows the carrier stripping means. This "image'wise" discharge thus not only facilitates the removal of the carrier particles from the photoconductive drum by reducing the electrostatic forces of adhesion but it also promotes the transfer printing of the toner image onto the paper web in the transfer station.

In order to guarantee the same penetration depth of the light into the surface of the charge image carrier as the light that is controlled in character-dependent fashion that generates the charge image, approximately the same spectral distribution as for the light of the character generator is recommended for the light of the exposure means.

When, for example, a light-emitting diode comb is employed as a character generator, then a similarly structured illumination means is also recommended for the exposure means.

The illumination also makes it possible to prevent memory effects on the charge image carrier that disturb the printed format due to charge images that are not completely quenched.

In an advantageous embodiment of the illumination means, the light source is surrounded by a light-transmissive, motor-driven protective drum, whereby this protective drum can be composed of a plexiglass tube. The illumination means comprising its protective tube is thereby arranged inside the developer station, namely in the proximity of the last developer drum in the transport direction of the charge image carrier, whereby it is continuously cleaned of adhering mix particles via this developer drum during operation.

BRIEF DESCRIPTION OF THE DRAWING

The drawing shows an embodiment of the invention and this shall be set forth in greater detail below by way of example.

DESCRIPTION OF THE PREFERRED EMBODIMENTS

FIG. 1 shows a schematic sectional view of a developer station in a non-mechanical fast-printer means comprising the illumination means of the invention. A photoconductive drum 10 is arranged as a charge image carrier in a printer means not shown in greater detail that operates according to the electrophotographic principle. A charge image is applied to this photoconductive drum 10 in a known fashion via an exposure means that is controlled in character-dependent fashioned and this charge image is then inked with the assistance of the illustrated developer station. The inking thereby ensues according to the reversal development principle wherein the regions discharged by the exposure are inked with the assistance of a developer mix 11 containing toner particles and carrier particles. After traversing the developer station, the charge images composed of colored toner particles are transferred onto paper in the standard way.

The developer station is essentially composed of a supply chamber 12 to which developer mix 11 is supplied via a filling aperture 13 comprising a drum of expanded material arranged therein as a metering means. An electromotively driven conveyor drum in the form of a paddle wheel drum 14 that comprises spoke-like paddles 15 for conveying the developer mix 11 is situated at the floor of the supply chamber 12. The supply chamber 12 is closed off from the photoconductive drum 10 by four developer drums 16, 17, 18 and 19. These developer drums arranged along the circumference of the photoconductive drum are situated at the tight spacing of about 1 through 2.5 mm from the surface of the photoconductive drum 10 and operate according to the magnetic brush principle. They are essentially composed of hollow cylinders 20 which are constantly driven via electromotive means and are of, for example aluminum having a knurled surface and having magnet arrangements 21 arranged therein. The hollow cylinders 20 are thereby charged with a bias voltage that exhibits approximately the size of 20 through 50% of the charge potential at the photoconductive drum 10. Given employment of a selenium photoconductive drum 10 having a charge potential of 400 through 1000 volts, the bias voltage has the size of 100 through 500 volts.

Depending upon the moving direction of their hollow cylinders, the developer drums 16, 17 and 18 are fashioned as what are referred to as isorunning developer drums. In the isorunning developer drums, the moving direction of their hollow cylinders 20 corresponds to the moving direction of the surface of the photoconductive drum 10 in the region of a developing gap 22 formed by the hollow cylinder 20 and the surface of the photoconductive drum 10. The last developer drum 19 is fashioned as a counterrunning developer drum wherein the hollow cylinder 20 moves in a direction opposite that of the photoconductive drum 10 in the development gap 22.

The transport of the developer mix 11 thereby ensues according to the arrows shown in FIG. 1 the figure such that the developer mix 11 is offered to the first isorunning developer drum 16 from the mix sump floor of the supply chamber 12 via the paddle wheel drum 14. A metering doctor 23 thereby defines the height of the carpet of developer mix on the first isorunning drum 16 and, thus, on the following isorunning drums 17 and 18 as well. Since the developer mix has developed the charge image contained on the photoconductive surface three times with considerably higher speed than the photoconductive surface (about 1.5 times the process speed), namely with the assistance of the isorunning developer drums 16, 17 and 18, the developer mix transfers from the third isorunning drum 18 onto the under side of the significantly slower, fourth counterrunning developer drum 19 that is driven in the opposite direction. A major part of the developer mix 11 is stripped off the fourth developer drum 19 by a further metering doctor 24 and the remaining developer mix is transported to the surface of the photoconductive drum 10 to develop the charge image a final time in counterrun. The spacings of the developer rollers advantageously lie under 2.5 mm, whereby the developing gap 22 has a width of 1 through 2.5 mm. The developer mix 11 must be conveyed through this development gap 22 with optimally high density. The density of the developer mix 11 must thereby be selected such that, first, the latent charge image is well-inked and, second, such that the surface of the charge image carrier is not damaged as a result of excessively great squeezing.

In order, first, to be able to transport the developer mix 11 with the assistance of the developer drums but, on the other hand, in order to be able to enable an agglomeration of the toner particles on the charge image, the surface of the developer drums, as already set forth, is charged with a bias voltage of about 20 through 50% of the charge potential.

An illumination means in the form of a light-emitting diode strip or light-emitting foil 25 that is accomodated in a protective drum 26 composed of a transparent, rotating plexiglass tube is situated above the last developer drum fashioned as a counterrunning developer drum 19. Rotation and spacing from the counterrunning developer drum 19 are adapted such that the surface of the plexiglass tube 26 is continuously cleaned of the developer mix 11 and a light exit region 27 of the light-emitting diode strip 25 is only slightly attenuated by adhering toner dust. The light-emitting diode strip 25 thereby generates a spectral light that approximately corresponds to the light of the character generator and is, for example, a LED comb.

Further, a carrier stripper drum 28 operating according to the magnetic brush principle in accord with the developer drums is situated above the illumination means 25. This carrier stripping drum 28 lifts the carrier particles of the developer mix 11 from the surface of the photoconductive drum 10 in collaboration with the illumination means and returns them to the developer mix 11 via a correspondingly fashioned guide channel.

Via the light-emitting diode strip 25, the illumination means levels the charge image in that it illuminates the highly charged (about 400 through 1000 volts) and non-toner-covered regions of the surface of the photoconductive drum 10 and thereby discharges them down to a residual voltage of less than 50 volts that thus corresponds to the discharge voltage of the character generator. The adhesion of negative carrier particles of the developer mix to the non-exposed regions of the surface of the photoconductive drum 10 is thus reduced, so that they can be stripped from the surface of the photoconductive drum 10 by the following carrier stripper drum 28 and can be returned into the developer station. Simultaneously memory effects due to charge images on the surface of the photoconductive drum that were not completely quenched can be prevented by the illumination means.

The illumination means generates a largely uniform charge image on the charge image carrier preceding the carrier stripper means and the following transfer station in the printer. The charge image carrier therewith is at a uniform residual charge voltage of about 50 volts. This "image-wise" discharging thus facilitates not only the removal of the carrier particles from the photoconductive drum but it also promotes the transfer of the toner image onto the paper web in the transfer station. In order to guarantee the same penetration depth of the light into the surface of the charge image carrier as the light that is controlled in character dependent fashion that generates the charge image, the light of the exposure means has approximately the same spectral structure as the light of the character generator. When, for example, a light-emitting diode comb is employed as the character generator, then a similarly structured illumination means is recommendable. Instead of a LED line, a light-emitting foil can also be employed.

The illumination means is surrounded by a suction means that acts on the region between the carrier stripper drum 28 and the protective drum 26 via a suction channel 29 extending along the illumination means. This suction channel 29 is in communication with a suction blower (not illustrated here) via a suction collecting channel 30. This air extraction between the plexiglass tube (protective drum) 26 comprising the illumination means and the carrier stripping drum 28 generates a local under-pressure and, thus, free toner dust that is not bonded by the charge image is collected in a container. The free toner dust can thus not be entrained upward out of the developer station by the photoconductive drum 10. Carrier particles stripped by the carrier stripping drum 28 and developer mix stripped by the metering doctor 24 of the counterrunning developer drum are returned into the supply chamber 12 via baffle plates 31.

An emptying aperture 32 via which used developer mix is suctioned off after a defined operating time is situated at the floor of the supply chamber 12.

We claim:

1. A non-mechanical printer or copier device, comprising:

a charge image carrier in the printer or copier device;

an exposure means in the printer or copier device for exposing said charge image carrier with a character image to produce a charge image on said charge image carrier;

a development region in the printer or copier device for developing by reversal development the charge image generated on said charge image carrier to thereby form charged and discharged regions on said charge image carrier, said development region utilizing a developer mix composed of toner particles and of carrier particles, said development region including development rollers positioned relative to said charge image carrier to apply the developer mix to regions of the charge image that are discharged by the character image exposure, and a means for removing carrier particles from the charge image carrier, said means following the development rollers in a moving direction of the charge image carrier;

an illumination means following said development region for illuminating the charge image carrier, said illumination means discharging by exposure highly charged and non-tonered regions of the charge image carrier, light generated in the illumination means roughly corresponding in terms of its spectral composition to light of the exposure means; and the illumination means being arranged inside the development region between the means for removing the carrier particles of the developer mix and the development region so that the carrier particle are removable by said means for removing while leaving the toner particles adhered to the charge image carrier for image transfer.

2. A non-mechanical printer or copier device according to claim 1, wherein aid exposure means comprises a light source surrounded by a light-transmissive, motor-driven protective drum; and further comprising: cleaning means for cleaning the protective drum of mix particles adhering thereto during operation.

3. A non-mechanical printer or copier device according to claim 2, wherein said protective drum is a plexiglass tube.

4. A non-mechanical printer or copier device according to claim 2, wherein said development region includes a developer drum arranged relative to said protective drum such that a surface of the protective drum is continuously cleaned of developer mix.

5. A non-mechanical printer or copier device, comprising:

a charge image carrier in the printer or copier device;

an exposure means in the printer or copier device for exposing said charge image carrier with a character image to produce a charge image on said charge image carrier;

a development region in the printer or copier device for developing by reversal development the charge image generated on said charge image carrier to thereby form charged and uncharged regions on said charge image carrier, said development utilizing a developer mix composed of toner particles and of carrier particles, said development region including development rollers positioned relative to said charge image carrier to apply the developer mix to regions of the charge image that are discharged by the character image exposure, and a means for removing carrier particles from the charge image carrier, said means following the development rollers in a moving direction of the charge image carrier;

an illumination means following said development region for illuminating the charge image carrier, said illumination means discharging by exposure highly charged and non-tonered regions of the charge image carrier, light generated in the illumination means roughly corresponding in terms of its spectral composition to light of the exposure means, the illumination means being arranged inside the development region between the means for removing and the development region; and a suction means for suctioning off developer mix parts that are not bonded to the charge image carrier, said suction means being between the illumination means and the means for removing the carrier particles.

* * * * *